US007126476B2

(12) United States Patent
Alkelai et al.

(10) Patent No.: US 7,126,476 B2
(45) Date of Patent: Oct. 24, 2006

(54) DUAL SENSOR INTRUDER ALARM

(75) Inventors: Moshe Alkelai, Tel-Aviv (IL); David Kartoun, Ramat Hasharon (IL)

(73) Assignee: Risco Ltd., Kiryat-Malachi (IL)

( * ) Notice: Subject to any disclaimer, the term of this patent is extended or adjusted under 35 U.S.C. 154(b) by 212 days.

(21) Appl. No.: 10/507,951

(22) PCT Filed: May 12, 2002

(86) PCT No.: PCT/IL02/00365

§ 371 (c)(1),
(2), (4) Date: Sep. 14, 2004

(87) PCT Pub. No.: WO03/096294

PCT Pub. Date: Nov. 20, 2003

(65) Prior Publication Data

US 2005/0151647 A1 Jul. 14, 2005

(51) Int. Cl.
*G08B 13/00* (2006.01)

(52) U.S. Cl. ..... 340/565; 340/522; 340/541; 340/554; 340/567

(58) Field of Classification Search ..... 340/521–522, 340/541, 565, 552, 554, 567, 573.1
See application file for complete search history.

(56) References Cited

U.S. PATENT DOCUMENTS 4,437,089 A 3/1984 Achard
5,077,548 A 12/1991 Dipoala
5,276,427 A * 1/1994 Peterson ..... 340/522
5,331,308 A * 7/1994 Buccola et al. ..... 340/522
5,504,473 A 4/1996 Cecic et al.
5,578,988 A * 11/1996 Hoseit et al. ..... 340/522
6,188,318 B1 2/2001 Katz et al.
6,246,321 B1 * 6/2001 Rechsteiner et al. ..... 340/522
6,486,778 B1 * 11/2002 Mahler et al. ..... 340/567
6,800,854 B1 * 10/2004 Pfister et al. ..... 250/338.1
2002/0044054 A1 * 4/2002 Krubiner et al. ..... 340/545.3

FOREIGN PATENT DOCUMENTS

EP 0 581 569 2/1994

* cited by examiner

*Primary Examiner*—Jeffery Hofsass
*Assistant Examiner*—Hoi C. Lau
(74) *Attorney, Agent, or Firm*—Fenster & Company

(57) ABSTRACT

A dual sensor intruder alarm (DSIA) for detecting an intruder in a security zone monitored by the DSIA comprising: a PIR sensor; an additional sensor, and a controller that determines an operating difference between the ambient temperature and a normative surface temperature of an intruder in the security zone; wherein if the operating difference is equal to or greater than a predetermined threshold difference, the controller determines whether an intruder is present in the security zone using signals from both the PIR sensor and the additional sensor and if the operating difference is less than the predetermined threshold difference, the controller uses signals from the additional sensor but not from the PIR sensor to determine presence of an intruder.

14 Claims, 2 Drawing Sheets

DUAL SENSOR INTRUDER ALARM

RELATED APPLICATIONS

The present application is a U.S. National Phase of PCT Application No. PCT/IL02/00365, filed on May 12, 2002.

FIELD OF THE INVENTION

The present invention relates to dual sensor intruder alarms (DSIAs) comprising an IR sensor and in particular to adjusting sensitivity of a DSIA, responsive to ambient temperature.

BACKGROUND OF THE INVENTION

A conventional DSIA generally comprises a microwave (MW) sensor module, hereinafter a "MW module", having a microwave transmitter/receiver and a passive infrared (PIR) sensor. For the DSIA to generate an alarm indicating presence of an intruder in a region, hereinafter a "security zone", protected by the DSIA, generally signals from both the MW module and the PIR sensor must provide evidence of the presence of the intruder. Various algorithms for processing signals from the MW module and the PIR sensor are used for deciding if the signals warrant determining that an intruder has trespassed the security zone. The requirement of "dual detection" for an intruder alarm, as implemented in a DSIA, reduces a probability that the alarm will generate false alarms and improves the reliability of the intruder alarm.

The MW module of a DSIA generates a signal indicating presence of an intruder in a security zone protected by the DSIA responsive to the intruder's motion. The motion causes a Doppler shift in a microwave transmitted by the MW module that is reflected from the intruder back to the MW module. The MW module is usually band limited to a range of Doppler shifts typical of Doppler shifts generated by motion of a human being in the security zone. Therefore, for the MW module to indicate presence of an intruder in the security zone, the Doppler shift must correspond to a "radial" velocity of a body towards or away from the MW module in a range of velocities typical of human motion. In addition, usually the intensity of the reflected microwaves must be greater than a predetermined threshold intensity for the MW module to indicate presence of an intruder.

The PIR sensor of a DSIA usually comprises two (in a "dual" PIR sensor) or four (in a "quad" PIR sensor) IR sensing elements. The IR sensing elements are generally connected in pairs in such a way that the sensing elements of a pair provide opposite polarity signals responsive to IR energy incident on the sensor. The PIR sensor responds to IR energy that reaches the sensor from regions, referred to as "fingers", of the security zone, which are separated by narrow "dead regions". The PIR sensor does not respond to IR energy from the dead regions. An intruder moving in the security zone across the fingers causes the PIR to generate a signal having a frequency responsive to a speed with which the intruder moves across the fingers. Signals generated by the PIR sensor are usually band limited to a range of frequencies typical of frequencies generated by motion of an intruder across the fingers of the security zone.

For a signal provided by the PIR sensor to indicate presence of an intruder, the DSIA generally requires that the signal be greater then a predetermined threshold signal. However, the sensitivity of the PIR sensor decreases as the ambient temperature approaches typical surface temperatures of a human intruder. To maintain a substantially constant detection sensitivity of the PIR sensor for the presence of an intruder, the DSIA generally compensates for loss of sensitivity of the PIR sensor as the ambient temperature approaches a "normative" human surface temperature. Compensation is usually achieved by either changing a threshold signal of the PIR sensor or gain of an amplifier that amplifies signals provided by the PIR sensor responsive to the ambient temperature.

A sensor, sensitivity, e.g. PIR sensor sensitivity, refers to sensitivity of the sensor for generating a signal responsive to a stimulus to which the sensor is intended to generate a signal. Detection sensitivity of a sensor in a DSIA, e.g. PIR sensor detection sensitivity, refers to an overall sensitivity of the sensor for generating a signal that the DSIA determines indicates presence of an intruder. The detection sensitivity is a function of sensitivity of the sensor and various criteria, e.g. amplitude thresholds, that the DSIA requires of signals generated by the sensor in order to "accept" the signals as indicating presence of an intruder. Detection sensitivity of a sensor may be adjusted by adjusting the sensitivity of the sensor, adjusting components of the DSIA that operate on signals generated by the sensor and/or adjusting any of the various "acceptability" requirements. Sensitivity of the DSIA for intruder detection refers to an "overall" sensitivity of the DSIA for detecting an intruder.

It is noted that a person's typical surface temperatures can be different for different types of clothing worn by the person and for different regions of the person's body, and is generally different from the usual internal body temperature of a healthy human. Generally, a normative surface temperature for a PIR sensor is determined responsive to the climatic conditions and clothing worn by persons in an environment in which the PIR sensor is intended to operate.

PIR temperature compensation is generally provided for ambient temperatures for which a difference, hereinafter an "operating temperature difference", between the ambient temperature and the normative surface temperature is greater than a predetermined threshold temperature differential. For an operating temperature difference less than the threshold differential, compensation is not provided and as the ambient temperature approaches the normative temperature, sensitivity of the PIR sensor for the presence of an intruder generally approaches zero. The threshold differential is typically set at between about 1° C. and about 3° C.

The cessation of compensation at the threshold temperature differential reduces the probability that noise, such as for example thermal noise or RF noise, will cause the PIR sensor to generate an erroneous signal indicating the presence of an intruder and thereby the probability that the DSIA generates a false alarm. However, the cessation of compensation also generally results in a reduction in the sensitivity of the PIR sensor and thereby of the DSIA for the detection of an intruder as the ambient temperature of the protected zone approaches the normative surface temperature.

U.S. Pat. No. 5,578,988 describes a DSIA in which a PIR threshold is adjusted responsive to temperature determined by a thermistor to maintain constant PIR sensor sensitivity. The DSIA also comprises a controller that adjusts the PIR threshold responsive to signals generated by the MW module and the MW module threshold responsive to PIR sensor signals. U.S. Pat. No. 5,331,308 describes a DSIA in which if a first one of two sensors in the DSIA continuously generates signals indicating presence of an intruder without confirmation by signals generated by the second sensor, the first sensor is assumed to be generating erroneous signals. The sensitivity of the second sensor is "stabilized" i.e.

reduced, so as to reduce a statistical probability of a coincidence between random alarm signals generated by the two sensors generating a false alarm.

U.S. Pat. No. 5,504,473 describes a DSIA in which signals from a MW module and a PIR sensor undergo separate statistical analysis to determine if the signals indicate motion of an intruder, typical noise or faulty operation (i.e. trouble such as circuit failure or masking) of the either of the sensors.

U.S. Pat. No. 6,188,318 describes a DSIA in which signals from a PIR sensor and a MW module are summed. The summed signal is compared to a threshold to determine whether or not an intruder is present in a zone protected by the DSIA. Signals from each of the sensors may be weighted by weighting factors prior to summing. "The weighting factors may be selected to customize the dual sensing intrusion device for optimal detection of an intruder in a given volume of space." The sum threshold may be determined to discriminate against the DSIA owner's pet.

SUMMARY OF THE INVENTION

An aspect of some embodiments of the present invention relates to providing an improved algorithm for operation of a DSIA comprising a PIR sensor and an additional sensor. The algorithm provides a method of using signals from the PIR sensor and from the additional sensor to determine presence of an intruder in a security zone monitored by the DSIA as ambient temperature of the security zone approaches a normative surface temperature determined for the zone.

An aspect of some embodiments of the present invention relates to providing a DSIA that operates in accordance with the algorithm.

In accordance with an embodiment of the present invention, a DSIA comprising a PIR sensor and an additional sensor has a double trigger mode of operation and a single trigger mode of operation. In the double trigger mode, signals from both the PIR sensor and the additional sensor are used to determine whether or not an intruder is present in a security zone monitored by the DSIA. In the double trigger mode the PIR sensor is optionally compensated for changes in its sensitivity as a function of ambient temperature to maintain a desired detection sensitivity for the PIR sensor, in accordance with any of various appropriate methods known in the art. In the single trigger mode of operation the DSIA determines whether an intruder is present in the security zone responsive to signals generated by the DSIA's additional sensor but not responsive to signals generated by the DSIA's PIR sensor.

In accordance with an embodiment of the present invention the DSIA operates in a single or double trigger mode responsive to the ambient temperature of the security zone, and a normative temperature and a differential threshold temperature that are established for the zone. The DSIA determines an operating temperature difference between the ambient temperature of the zone and the normative surface temperature. If the operating temperature difference is greater than or equal to the differential threshold temperature, the DSIA operates in the double trigger mode. If the operating temperature difference is less than the differential threshold temperature the DSIA operates in the single trigger mode.

In accordance with some embodiments of the present invention, to reduce a probability of false alarms when the DSIA is operating in the single trigger mode, detection sensitivity of the additional sensor is reduced below a detection sensitivity at which the additional sensor operates in the double trigger mode. An amount by which the detection sensitivity is reduced is optionally such that sensitivity of the DSIA in the single trigger mode is equal to or greater than it would be in a double trigger mode for which the PIR sensor is uncompensated and an operating difference is less than the differential threshold.

There is therefore provided, in accordance with an embodiment of the present invention a dual sensor intruder alarm (DSIA) for detecting an intruder in a security zone monitored by the DSIA comprising: a PIR sensor; an additional sensor; and a controller that determines an operating difference between the ambient temperature and a normative surface temperature of an intruder in the security zone; wherein if the operating difference is equal to or greater than a predetermined threshold difference, the controller operates in a dual trigger mode and determines whether an intruder is present in the security zone using signals from both the PIR sensor and the additional sensor and if the operating difference is less than the predetermined threshold difference, the controller operates in a single trigger mode and uses signals from the additional sensor but not from the PIR sensor to determine presence of an intruder.

Optionally, in the single trigger mode the controller reduces detection sensitivity of the additional sensor for generating a signal that is acceptable as indicating presence of an intruder relative to a detection sensitivity of the additional sensor in the double trigger mode.

Optionally, an amount by which the detection sensitivity of the additional sensor is reduced is such that sensitivity of the DSIA for intruder detection is equal to or greater than a sensitivity of the DSIA operating in a double trigger mode at an ambient temperature for which the operating difference is less than the predetermined difference and sensitivity of the PIR sensor is not temperature compensated.

In some embodiments of the present invention, the DSIA comprises means for compensating the PIR sensor for changes in temperature when operating in the double trigger mode.

In some embodiments of the present invention, the additional sensor comprises a microwave (MW) detection module.

In some embodiments of the present invention, the additional sensor comprises an acoustic sensor.

In some embodiments of the present invention, the additional sensor comprises an optical sensor.

There is further provided, in accordance with an embodiment of the present invention, a method for determining presence of an intruder in a security zone, the method comprising: monitoring the zone using a PIR sensor and an additional sensor that generate signals responsive to presence of an intruder in the zone; determining an ambient temperature for the security zone; determining an operating temperature difference between the ambient temperature and a normative surface temperature for an intruder in the zone; using signals from both the PIR and additional sensors to determine presence of an intruder in the zone if the operating difference is greater than or equal to a predetermined threshold temperature difference; and using signals from the additional sensor but not the PIR sensor to determine presence of an intruder in the zone if the operating difference is less than the threshold temperature difference.

Optionally the method comprises when using signals from the additional sensor but not the PIR sensor, reducing detection sensitivity of the additional sensor relative to a detection sensitivity of the additional sensor when using signals from both the PIR sensor and the additional sensor.

Optionally, an amount by which the detection sensitivity of the additional sensor is reduced is such that sensitivity for intruder detection is greater than a sensitivity for intruder detection obtained by using signals from the PIR sensor and the additional sensor for an ambient temperature for which the operational difference is less than the threshold difference and the PIR sensor is not temperature compensated.

In some embodiments of the present invention, the method comprises compensating sensitivity of the PIR sensor for changes in temperature when signals from both the PIR and additional sensors are used.

In some embodiments of the present invention, the additional sensor comprises a microwave (MW) detection module.

In some embodiments of the present invention, the additional sensor comprises an acoustic sensor.

In some embodiments of the present invention, the additional sensor comprises an optical sensor.

BRIEF DESCRIPTION OF FIGURES

Non-limiting examples of embodiments of the present invention are described below with reference to figures attached hereto and listed below. In the figures, identical structures, elements or parts that appear in more than one figure are generally labeled with a same numeral in all the figures in which they appear. Dimensions of components and features shown in the figures are chosen for convenience and clarity of presentation and are not necessarily shown to scale.

DETAILED DESCRIPTION OF EXEMPLARY EMBODIMENTS

Figure 1:
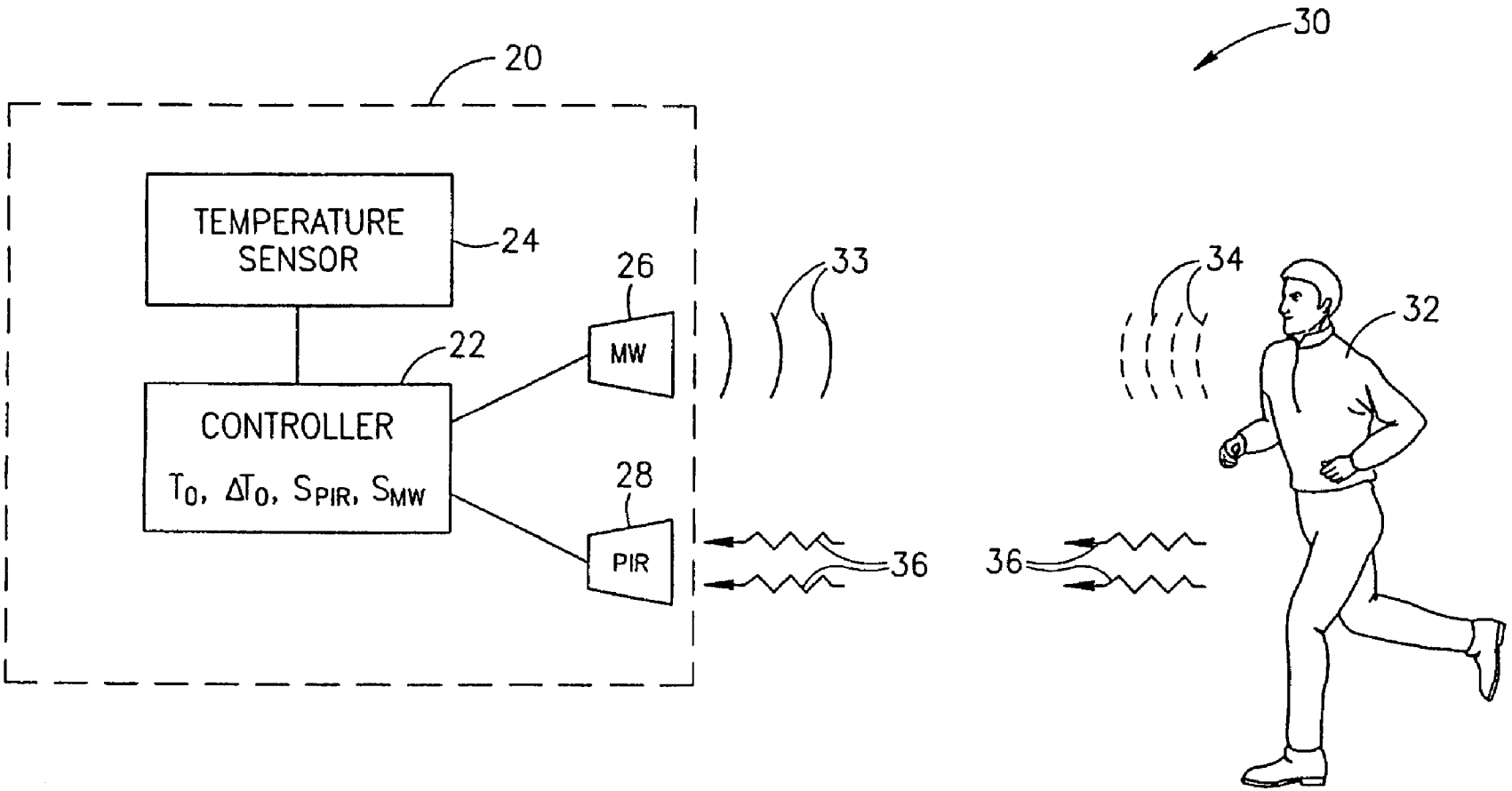
FIG. 1 schematically shows a DSIA in accordance with an embodiment of the present invention.

FIG. 1 schematically shows a DSIA 20 selectively operable in either a double trigger mode or a single trigger mode, in accordance with an embodiment of the present invention. DSIA 20 comprises a temperature sensor 24, schematically represented by a thermometer, that provides a measurement of ambient temperature, a PIR sensor 28 and an additional sensor 26 and a controller 22. Additional sensor 26 may be any sensor or detector, or sensor module suitable for indicating presence of an intruder, such as an acoustic sensor, optical sensor or a MW module. For simplicity and convenience of presentation it is assumed that additional sensor 26 is a MW module. DSIA 20 is schematically shown, by way of example, protecting a security zone 30 in which an intruder 32 is moving with a component of motion towards the DSIA.

MW module 26 radiates microwaves that are schematically shown by curved lines 33. Microwaves 33 have a frequency suitable for intruder detection schematically indicated by spacing between lines 33. A portion of the energy in microwaves 33 is Doppler shifted and reflected by intruder 32 as microwaves indicated by dashed lines 34. Spacing of dashed lines 34 is less than that of curved lines 33 to schematically indicate the Doppler shift caused by motion of the intruder. The Doppler shift is positive because the intruder is moving towards DSIA 20. (Were the intruder moving away from DSIA 20, the Doppler shift would be negative.)

MW module 26 generates signals responsive to reflected microwaves 34 and transmits the signals to controller 22. Controller 22 processes the signals to determine if they indicate presence of intruder 32 responsive to at least one characteristic of the reflected microwaves indicated by the signals, in accordance with any of various methods known in the art. Typically, Doppler shift and intensity of microwaves are used to determine presence of an intruder. Controller 22 determines MW detection sensitivity "$S_{MW}$" of MW module 26 as discussed below and noted in the summary above.

PIR sensor 28 receives IR radiation, indicated by wavy arrows 36, from intruder 32 and generates signals responsive thereto that are transmitted to controller 22. Controller 22 determines, in accordance with any of various methods known in the art, whether or not the signals indicate the presence of intruder 32 responsive to a characteristic, such as for example intensity and/or a frequency, of the signals. Controller 22 determines PIR sensor detection sensitivity "$S_{PIR}$" responsive to temperature as discussed below and noted in the summary above.

In accordance with an embodiment of the present invention, controller 22 determines whether DSIA 20 operates in a double trigger mode or a single trigger mode responsive to an ambient temperature T of security zone 30 provided by temperature sensor 24, a normative temperature $T_O$ and an operating temperature difference $\Delta T$. Any of various methods known in the art may be used to "provide" controller 22 with ambient temperature T and with values for normative temperature $T_O$ and operating temperature difference $\Delta T_O$, which values may be pre-set or adjustable. In the dual trigger mode signals from both MW module 26 and PIR sensor 28 are used to determine presence of intruder 32. In the single trigger mode, signals only from MW module 26 are used to determine presence of intruder 32. A decision as to whether to operate in the dual trigger mode or single trigger mode is made in accordance with an algorithm having a flow chart similar that shown in FIG. 2.

Figure 2:
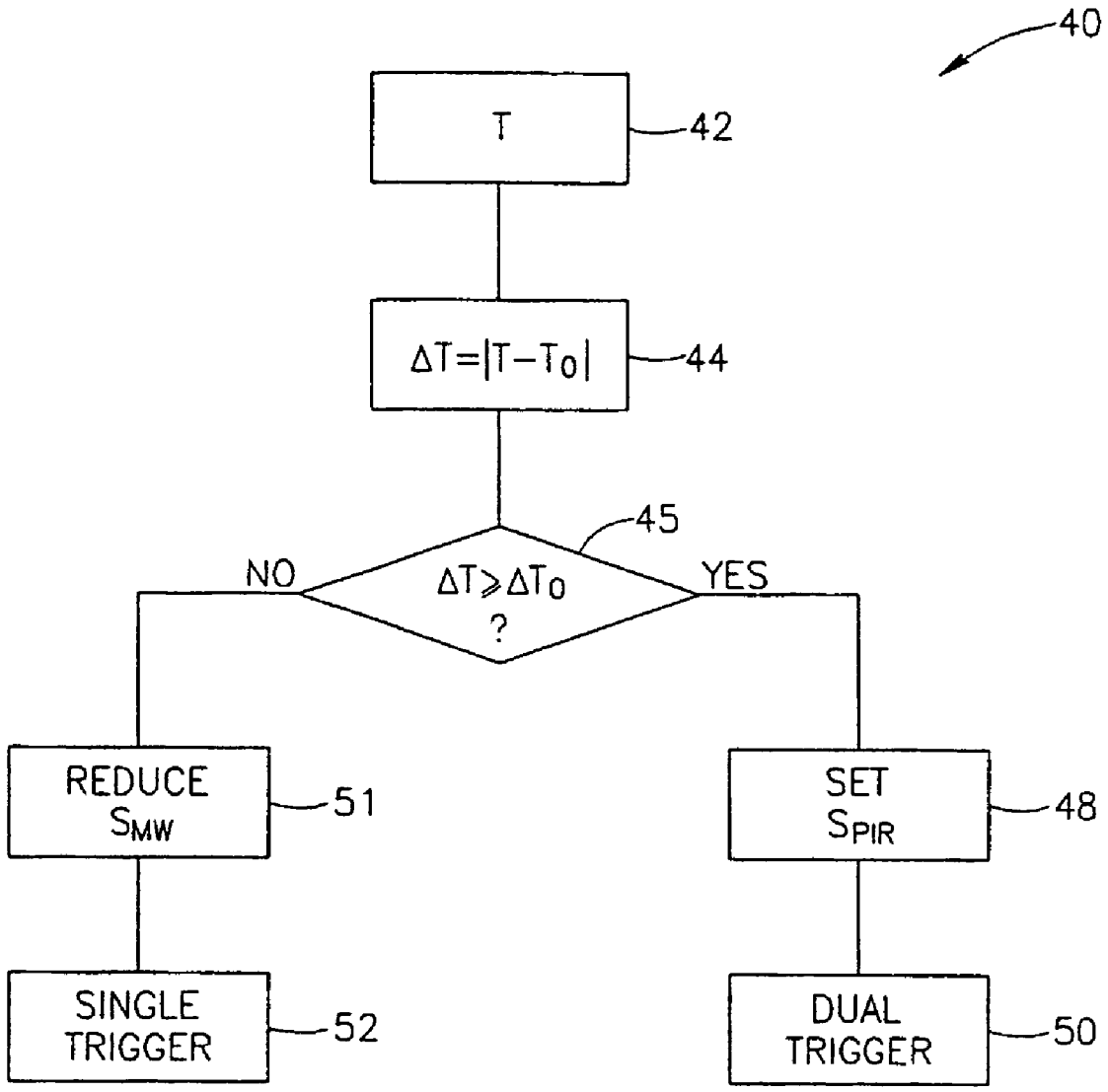
FIG. 2 shows a flow diagram of an algorithm by which the DSIA shown in FIG. 1 determines whether to operate in a dual or single detection mode, in accordance with an embodiment of the present invention.

FIG. 2 shows an algorithm 40 by which controller 22 determines whether DSIA 20 operates in a dual trigger mode or a single trigger mode, in accordance with an embodiment of the present invention.

In a block 42 controller 22 receives a signal from temperature sensor 24 indicative of ambient temperature T of security zone 30. In block 44 controller 22 determines an operating temperature difference, $\Delta T$, between ambient temperature T of security zone 30 and normative temperature $T_O$. Optionally $\Delta T$ is equal to an absolute difference and $\Delta T = |T - T_O|$. In block 45 controller 22 compares $\Delta T$ with $\Delta T_O$.

If $\Delta T \geqq \Delta T_O$, controller 22 proceeds to a block 48. In block 48 controller 22 sets PIR detection sensitivity $S_{PIR}$ of DSIA 20 by compensating sensitivity of PIR sensor 28 in accordance with any suitable method known in the art. Alternatively, PIR sensor 28 can have internal compensation. In block 48, detection sensitivity $S_{MW}$ of MW module 26 may also be determined by any suitable method, criteria and/or algorithm known in the art.

In block 50 controller 22 sets DSIA to the dual trigger mode and uses signals from both PIR sensor 28 and MW module 26 to determine presence of an intruder, by way of example, intruder 32 in FIG. 1, in security zone 30. Any of various methods known in the art may be used to determine presence of intruder 32 from signals provided by PIR sensor 28 and MW module 26.

If on the other hand $\Delta T < \Delta T_O$, controller 22 proceeds to a block 51. In block 51 controller 22 optionally reduces detection sensitivity $S_{MW}$ of MW module 26 below that used in the double trigger mode to reduce probability of false alarms and proceeds to a block 52. In block 52 controller 22 sets DSIA 20 to the single trigger mode and uses signals from MW module 26 but not from PIR sensor 28 to determine presence of an intruder in security zone 30. Optionally, in step 51 $S_{MW}$ is not reduced to such an extent that sensitivity of DSIA 20 for detecting an intruder in the single trigger mode is less than a sensitivity of the DSIA operating in a double trigger mode for which $\Delta T<\Delta T_O$ and PIR sensor 28 is not temperature compensated.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

The invention claimed is:

1. A dual sensor intruder alarm (DSIA) for detecting an intruder in a security zone monitored by the DSIA comprising:

a PIR sensor;

an additional sensor;

a controller that determines an operating difference between the ambient temperature and a normative surface temperature of an intruder in the security zone; and wherein if the operating difference is equal to or greater than a predetermined threshold difference, the controller operates in a dual trigger mode and determines whether an intruder is present in the security zone using signals from both the PIR sensor and the additional sensor and if the operating difference is less than the predetermined threshold difference, the controller operates in a single trigger mode and uses signals from the additional sensor but not from the PIR sensor to determine presence of an intruder.

2. A DSIA according to claim 1 wherein in the single trigger mode the controller reduces detection sensitivity of the additional sensor for generating a signal that is acceptable as indicating presence of an intruder relative to a detection sensitivity of the additional sensor in the double trigger mode.

3. A DSIA according to claim 2 wherein an amount by which the detection sensitivity of the additional sensor is reduced is such that sensitivity of the DSIA for intruder detection is equal to or greater than a sensitivity of the DSIA operating in a double trigger mode at an ambient temperature for which the operating difference is less than the predetermined difference and sensitivity of the PIR sensor is not temperature compensated.

4. A DSIA according to claim 1 and comprising means for compensating the PIR sensor for changes in temperature when operating in the double trigger mode.

5. A DSIA according to claim 1 wherein the additional sensor comprises a microwave (MW) detection module.

6. A DSIA according to claim 1 wherein the additional sensor comprises an acoustic sensor.

7. A DSIA according to claim 1 wherein the additional sensor comprises an optical sensor.

8. A method for determining presence of an intruder in a security zone, the method comprising:

monitoring the zone using a PIR sensor and an additional sensor that generate signals responsive to presence of an intruder in the zone;

determining an ambient temperature for the security zone;

determining an operating temperature difference between the ambient temperature and a normative surface temperature for an intruder in the zone;

using signals from both the PIR and additional sensors to determine presence of an intruder in the zone if the operating difference is greater than or equal to a predetermined threshold temperature difference; and using signals from the additional sensor but not the PIR sensor to determine presence of an intruder in the zone if the operating difference is less than the threshold temperature difference.

9. A method according to claim 8 and comprising when using signals from the additional sensor but not the PIR sensor, reducing detection sensitivity of the additional sensor relative to a detection sensitivity of the additional sensor when using signals from both the PIR sensor and the additional sensor.

10. A method according to claim 9 wherein an amount by which the detection sensitivity of the additional sensor is reduced is such that sensitivity for intruder detection is greater than a sensitivity for intruder detection obtained by using signals from the PIR sensor and the additional sensor for an ambient temperature for which the operational difference is less than the threshold difference and the PIR sensor is not temperature compensated.

11. A method according to claim 8 and comprising compensating sensitivity of the PIR sensor for changes in temperature when signals from both the PIR and additional sensors are used.

12. A method according to claim 8 wherein the additional sensor comprises a microwave (MW) detection module.

13. A DSIA according to claim 8 wherein the additional sensor comprises an acoustic sensor.

14. A DSIA according to claim 8 wherein the additional sensor comprises an optical sensor.

* * * * *